US008573833B2

(12) United States Patent
Yang et al.

(10) Patent No.: US 8,573,833 B2
(45) Date of Patent: Nov. 5, 2013

(54) ATTACHABLE TIMEPIECE

(71) Applicants: Eric Yang, Fountain Valley, CA (US); Meghan Yang, Fountain Valley, CA (US)

(72) Inventors: Eric Yang, Fountain Valley, CA (US); Meghan Yang, Fountain Valley, CA (US)

( * ) Notice: Subject to any disclaimer, the term of this patent is extended or adjusted under 35 U.S.C. 154(b) by 0 days.

(21) Appl. No.: 13/762,242

(22) Filed: Feb. 7, 2013

(65) Prior Publication Data

US 2013/0250736 A1 Sep. 26, 2013

Related U.S. Application Data

(63) Continuation-in-part of application No. 13/040,165, filed on Mar. 3, 2011, now Pat. No. 8,444,313.

(51) Int. Cl.
*G04B 37/12* (2006.01)

(52) U.S. Cl.
USPC ..... 368/278; 368/291

(58) Field of Classification Search
USPC ..... 368/21, 276–278, 239; D10/21, 24–26, D10/1, 30
See application file for complete search history.

(56) References Cited

U.S. PATENT DOCUMENTS

| | | | | | |
|---|---|---|---|---|---|
| 3,262,258 | A | * | 7/1966 | Poynter | 368/80 |
| D224,749 | S | * | 9/1972 | Cohen | D14/170 |
| D296,675 | S | * | 7/1988 | Jones et al. | D10/31 |
| D300,006 | S | * | 2/1989 | Booty | D10/22 |
| D312,578 | S | * | 12/1990 | Kumakura | D10/22 |
| D319,396 | S | * | 8/1991 | Mayuzumi | D10/24 |
| D326,124 | S | * | 5/1992 | Thomson et al. | D21/531 |
| D336,859 | S | * | 6/1993 | Muller | D10/30 |
| 5,365,495 | A | * | 11/1994 | Cussen | 368/79 |
| D362,190 | S | * | 9/1995 | Neuse | D10/22 |
| 5,526,327 | A | * | 6/1996 | Cordova, Jr. | 368/82 |
| D415,691 | S | * | 10/1999 | Lin | D10/22 |
| 7,408,846 | B2 | * | 8/2008 | Brodmann | 368/228 |
| D621,725 | S | * | 8/2010 | Wu | D10/20 |
| D644,950 | S | * | 9/2011 | Cooper | D10/128 |
| 2001/0024404 | A1 | * | 9/2001 | Ito | 368/10 |

* cited by examiner

*Primary Examiner* — Sean Kayes
(74) *Attorney, Agent, or Firm* — Sheppard Mullin Richter & Hampton LLP

(57) ABSTRACT

A timepiece, comprising first and second arms connected at one end at an acute angle, and a bar locking system located in a wedge area of the timepiece where the arms are connected at the acute angle, wherein the first and second arms are hollow such that they can house electrical components, and wherein the bar locking system is employed to attach the timepiece to a leash plug of a surfboard.

20 Claims, 13 Drawing Sheets

ATTACHABLE TIMEPIECE

REFERENCE TO RELATED APPLICATIONS

This application is a continuation-in-part of U.S. patent application Ser. No. 13/040,165 filed Mar. 3, 2011, the content of which is incorporated herein by reference in its entirety.

TECHNICAL FIELD

The present invention relates generally to an attachable timepiece, and more particularly, to an attachable timepiece for surfers.

DESCRIPTION OF THE RELATED ART

When surfers surf, they are inextricably are tied to time. This holds true whether it is before work, during lunch, before an appointment/meeting, or just trying to not get a parking ticket from the expiring meter.

One may ask, "well, don't surfers wear watches?!" The answer is a resounding "NO!" Most surfers will tell you that from their experience in the water, one simply cannot find the time from anyone! Even in the busiest surf spots, e.g., in Southern California, it is almost impossible to get the time from a fellow surfer.

The reason why most surfers do not wear watches is due to the fact that it restricts wrist movement while paddling and popping up. Additionally, watches are know to be cumbersome, annoying, difficult to wear with a wetsuit, and uncomfortable. Furthermore, most sporting watches such as G-Shock, Freestyle and Quiksilver are bulky and oversized.

In view of the above, there exists a need for a practical timepiece for surfers that does not suffer from the known drawbacks set forth above.

BRIEF SUMMARY OF EMBODIMENTS OF THE INVENTION

Embodiments of the present invention provide attachable timepieces for various activities such as surfing.

One particular embodiment provides an attachable timepiece, comprising: an upper chamber forming a housing for timepiece elements, the upper chamber including a front face having a time display; a lower chamber that is detachable from the upper chamber by way of a locking system; and a means for attaching the timepiece to an object. The means for attaching may comprise a looped string that is attached to the lower chamber. The lower chamber is hollow and includes a centrally disposed aperture for the passage of the looped string prior to being knotted within the lower chamber, thereby connecting the looped string to the lower chamber.

In some configurations, the front face of the timepiece is substantially flat and the time display comprises a digital time display. In addition, the locking system may comprise a threaded section disposed on an outside portion of the upper chamber that is configured to mate with a corresponding threaded section disposed on an inside portion of the lower chamber. The upper chamber is detached from the lower chamber by unscrewing the upper chamber from the lower chamber. In some embodiments, the upper chamber makes an audible snap when fully screwed onto the lower chamber indicating that the chambers are in locking engagement.

According to certain embodiments, the timepiece is configured to be attached to a surfboard leash plug, wherein the looped string is threaded through the surfboard leash plug and pulled until the lower chamber is forced against the plug. In such embodiments, the lower chamber is configured to engage the surfboard leash plug such that the front face remains visible to the user. The looped string provides a means for user to attach a surfboard leash.

According to other embodiments, the timepiece is attached to an object that is selected from the group consisting of a paddle board, a wake board, a ski, a snowboard, wind surfing gear, kite boarding gear, hiking gear, tennis gear, swimming gear, diving gear, fishing gear, golfing gear, and basketball gear.

Further embodiments of the invention are directed toward an attachable timepiece, comprising: an upper chamber forming a housing for timepiece elements, the upper chamber including a front face having a digital time display and a threaded section; a lower chamber having a threaded section corresponding to the threaded section of the upper chamber such that the chambers are configured to be screwed together; and a looped string that is attached to the lower chamber, wherein the looped string is used to releasably attach a surfboard to a surfboard leash.

Another embodiment of the invention is directed toward a timepiece, comprising first and second arms connected at one end at an acute angle, and a means for attaching the timepiece to an object, wherein the first and second arms are hollow such that they can house electrical components. In some configurations, the timepiece comprises a boomerang shape and/or a V-shape. The means for attaching the timepiece can comprise a bar locking system located in a wedge area of the timepiece where the arms are connected at the acute angle. In some cases, the bar locking system may comprise a pair of bars formed in a substantially T-shaped configuration, and a looped string threaded through the bars.

In some embodiments, the timepiece further comprises a display including the time and a reading for water temperature. The timepiece may further comprise a vibrating alarm to alert the surfer when a selected amount of time has expired. Additionally, the timepiece can include a user interface system comprising a two-button user interface system having a pair of buttons disposed on the distal ends of the timepiece arms. Another feature of the timepiece is a thermistor for measuring water temperature. Some embodiments of the timepiece include a solar panel for capturing the sun's energy and a solar charged lithium polymer battery for powering the timepiece using the captured energy.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a waterproof and impact-resistant timepiece for surfers that connects to a surfboard. More particularly, some embodiments of the invention are directed toward a timepiece that connects to a surfboard's "plug," thereby becoming the leashes "string tether." As used herein, the term "plug" describes a mounting means on a surfboard for connecting the leash and/or timepiece to the board. Additionally, as set forth herein, the term "string tether" describes a string, rope, cord or other attachment means for connecting connects the leash to the plug. The timepiece of the invention is readily detachable such that it can be interchanged between surfboards.

According to further embodiments of the invention, the attachable timepiece can be used for many other activities than just surfing. The attachable timepiece is particularly useful during those activities wherein it is beneficial to have one's wrists free from encumbrances such that full motion of the wrist is possible. By way of example, such activities include, but are not limited to, rock climbing, paddle boarding, wake boarding, skiing, snowboarding, wind surfing, kite boarding, hiking, tennis, swimming laps, diving, fishing, golfing, and basketball, and many other activities. Because the timepiece of the invention includes a string loop, it can be connected to almost any object, including without limitation, belt loops, belts, jackets, shoes, etc.

Figure 1A:
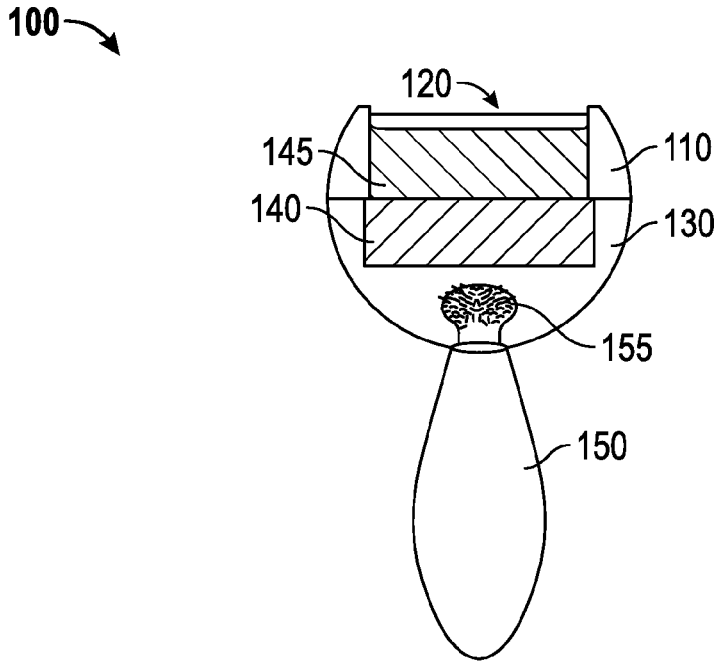
FIGS. 1A-1D are cross-sectional, top, upper chamber perspective, and lower chamber perspective views, respectively, of an attachable timepiece in accordance with the principles of the invention.

FIG. 1A is a cross-sectional view illustrating an attachable timepiece 100 in accordance with the principles of the invention. As depicted, the timepiece 100 comprises a spherical shape with the exception of the front face 120, which is a substantially flat surface. The substantially spherical shape gives the timepiece 100 sufficient strength to resist most impacts, and results in a product without sharp edges. As would be appreciated by those of skill in the art, many other timepiece shapes may be employed without departing from the scope of the invention. More particularly, the attachable timepiece 100 comprises an upper chamber 110 (including front face 120) that is detachable from a lower chamber 130 via a locking system 140. The attachable timepiece 100 further comprises a means 150 for attaching the timepiece 100 to an object such as the plug of a surfboard. As depicted, this means for attachment may comprise a looped string 150 that is tied into a knot 155 inside the lower chamber 130 of the timepiece 100.

Figure 1B:
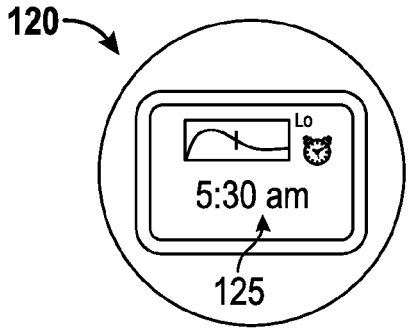

FIG. 1B is a top view of the attachable timepiece 100 illustrating its front face 120 including a digital time display 125. Alternatively, the front face 120 may feature a different time display such as a traditional analogue display face having Roman numerals, an hour hand and a minute hand. In further embodiments, the front face 120 may include additional conventional features such as displaying the current date, a tide gauge, alarms, stopwatch features, etc. Such conventional features are well known in the art.

Figure 1C:
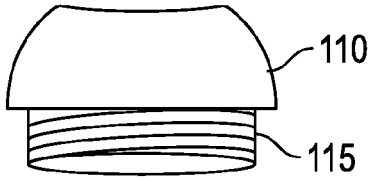
Figure 1D:
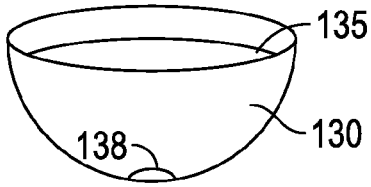

As stated, the timepiece 100 comprises two separate pieces or chambers 110, 130 attached via locking system 140. In the illustrated embodiment, the locking system 140 comprises a threaded section 115 disposed on the outside of upper chamber 110 that is configured to mate with a corresponding threaded section 135 disposed on the inside of lower chamber 130. Specifically, the two chambers 110, 130 can be detached by unscrewing the upper chamber 110 from the lower chamber 130, as illustrated in FIGS. 1C and 1D. In some embodiments, the locking system 140 is similar to that of a medicine bottle, i.e., the cap (upper chamber) makes an audible snap when fully screwed onto the bottle (lower chamber) so that it does not come undone during use. A rubber gasket may be employed to provide a tight seal between the chambers 110, 130, thereby ensuring the timepiece remains waterproof.

As depicted, the lower chamber 130 is hollow and includes a centrally disposed aperture 138 for the passage of the looped string 150 prior to being knotted within the lower chamber 130. The upper chamber 110 comprises the casing for housing the timepiece elements 145, which may include the display, battery, and other conventional timepiece elements, per se known in the art. The ability to unscrew the chambers 110, 130 allows the user to access the battery or other conventional timepiece elements for maintenance or replacement. The chambers 110, 130 may be formed of any suitable material such as a light metal or a hard plastic. In addition, the outside surface of the chambers 110, 130 may be provided with a suitable coating such as a thin rubber coating in order to enhance durability and water resistance.

Figure 2A:
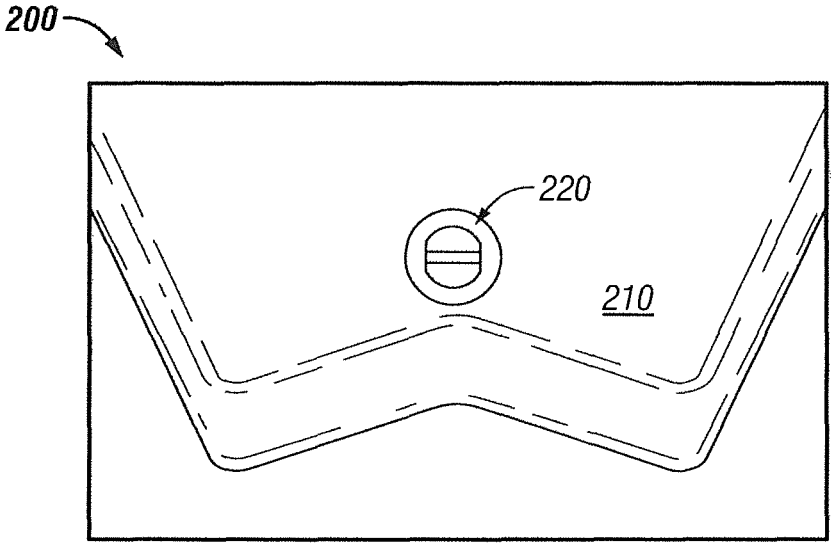
FIG. 2A is a perspective view showing a surfboard with a tail end having a conventional leash plug for attaching a leash to the surfboard.

FIG. 2A illustrates a surfboard 200 with a tail end 210 having a conventional leash plug 220 for attaching a leash to the surfboard 200. This conventional leash plug 220 a standard feature of virtually all surfboards.

Figure 2B:
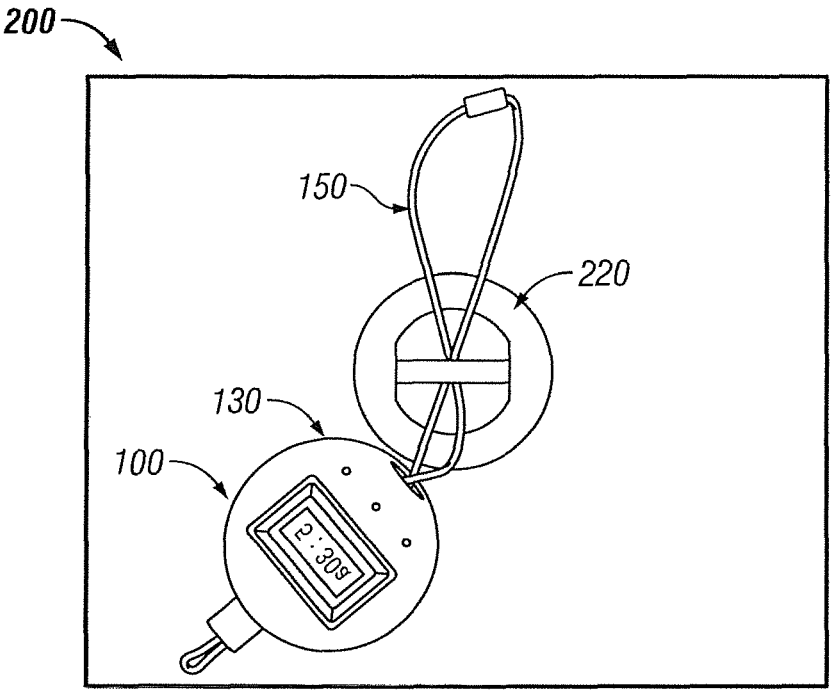
FIG. 2B is a perspective view showing the timepiece being attached to the leash plug.

FIG. 2B illustrates the looped string 150 being looped through the plug 220 and pulled until it is taut, such that the looped string 150 can now take the place of a conventional surfboard leash string. In other words, the looped string 150 is threaded through the plug 220 such that when the string 150 is pulled, the timepiece 100 is forced against the plug 220. However, since the timepiece 100 is larger than the plug 220, it remains in place adjacent the plug 220. Because the timepiece 100 is one-sided (i.e., only the front face 120 is flat), this allows the rounded lower chamber 130 to enter and hug the base of the plug 220. This prevents the timepiece 100 from whipping or leveraging against the surfboard 200 during use, thereby preventing damage to the surfboard 200.

Figure 2C:
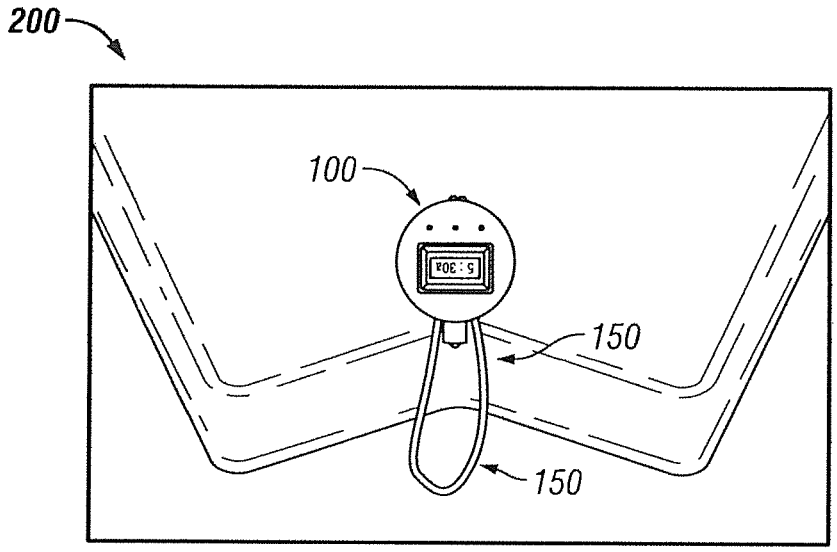
FIG. 2C is a perspective view illustrating the timepiece secured to the plug.

FIG. 2C illustrates the timepiece 100 in place, secured against the plug 220, and ready for a conventional surfboard leash to be connected to the looped string 150. During use, the substantially spherical shape of the timepiece 100 provides sufficient strength to resist most impacts. This design also results in a product without sharp edges to one's foot or ding one's board.

Figure 3:
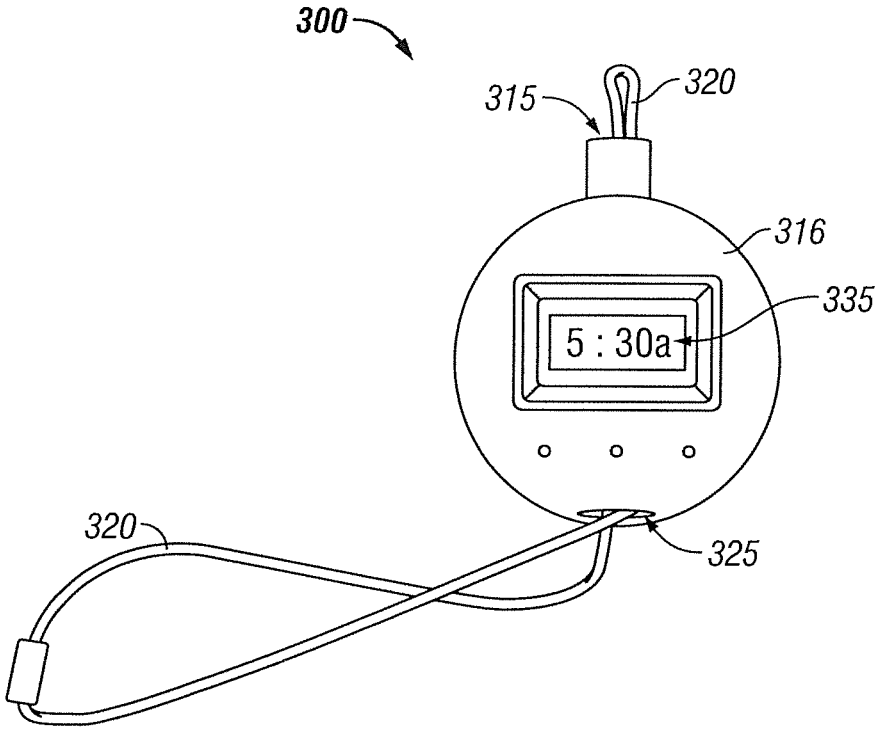
FIG. 3 is a front view illustrating an alternative attachable timepiece in accordance with the principles of the invention.

FIG. 3 depicts an alternative embodiment of the invention wherein timepiece 300 is similar in some ways to the timepiece 100 of FIG. 1. However, unlike timepiece 100, timepiece 300 comprises a substantially hollow sphere 310 having a top aperture 315 and a bottom aperture 325 allowing the looped string 320 to be fed through the timepiece 300 via apertures 315, 325. Similar to the previous embodiment, the timepiece 300 includes a digital time display 335. A knot 340 may be tied in the string 320 such that it cannot pass through aperture 325, thus allowing the timepiece to be attached to a conventional plug 220 as set forth above with respect to FIG. 2.

Figure 4A:
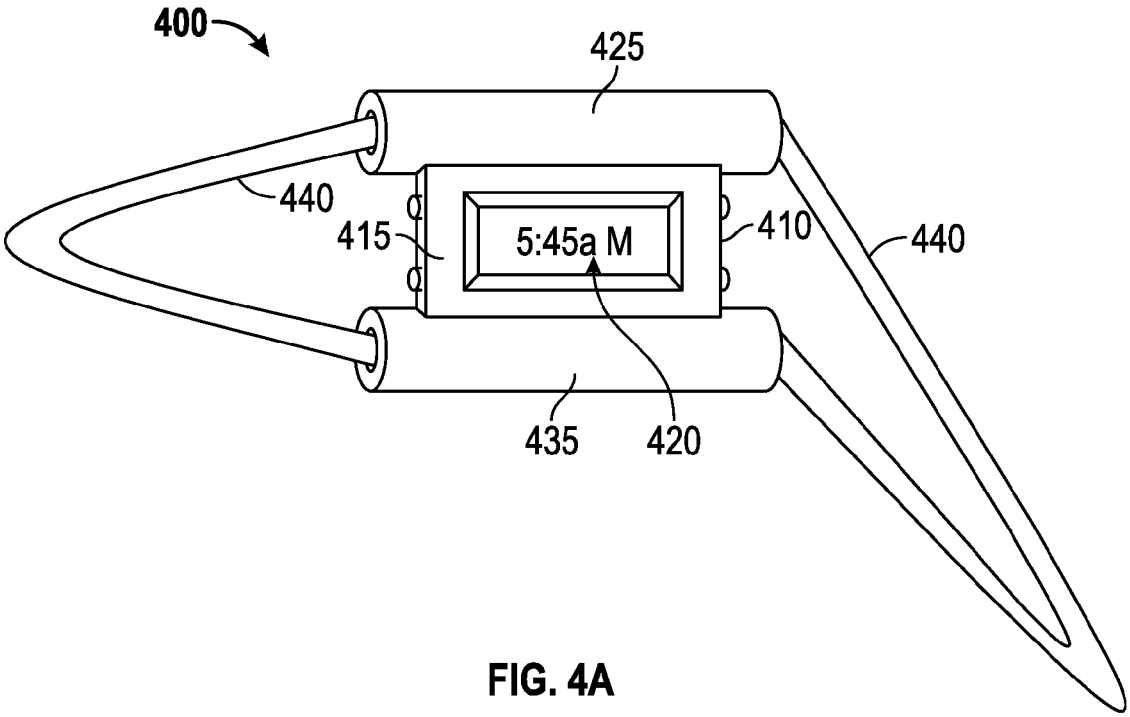
FIGS. 4A and 4B are front and cross-sectional views, respectively, illustrating another alternative attachable timepiece in accordance with the principles of the invention.
Figure 4B:
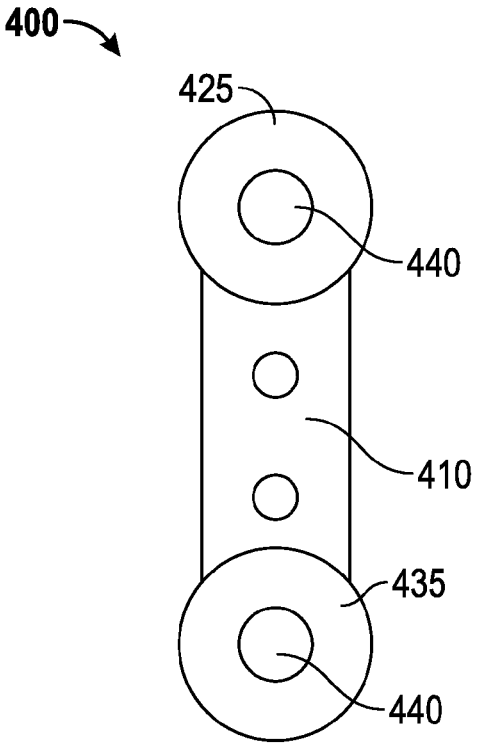

FIGS. 4A and 4B illustrate another alternative embodiment of the invention wherein timepiece 400 is similar in some ways to the previously described timepieces. As depicted, timepiece 400 comprises a substantially rectilinear portion 410 having a front face 415 including a digital time display 420. The timepiece further comprises a top cylinder 425 attached at the top of portion 410 and a bottom cylinder 435 attached to the bottom of portion 410. In this embodiment, looped string 440 is threaded through the cylinders 415, 425 and once end of the looped string 440 is pulled through and attached to a conventional plug 220, as set forth above with respect to FIG. 2.

Figure 5A:
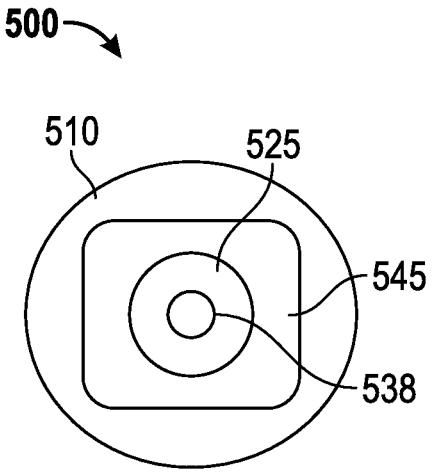
FIGS. 5A and 5B are top and cross-sectional views, respectively, illustrating a substantially solid timepiece in accordance with the principles of the invention.
Figure 5B:
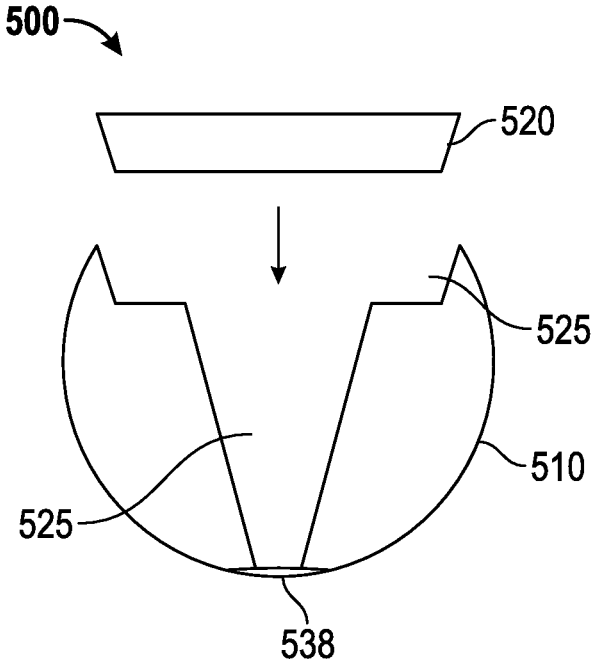

FIGS. 5A and 5B illustrate an attachable timepiece 500 comprising a substantially solid piece in accordance with the principles of the invention. In particular, the timepiece 500 comprises a semi-circular one-piece casing 510 that mates with a substantially flat front face 520. As set forth above, other timepiece shapes are possible without departing from the scope of the invention. The front face 520 is detachable from the casing 510 via a locking system 540. The attachable timepiece 500 further comprises a means for attaching the timepiece 100 to an object such as the plug of a surfboard. Similar to previous embodiments, the means for attachment may comprise a looped string that is tied into a knot inside a hollow portion 525 of the casing 510 such that the looped string passes through centrally disposed aperture 538 at the bottom of casing 510.

In the illustrated embodiment, the hollow portion 525 is cone-shaped to facilitate the knot being wedged securely within the hollow portion 525 when the string is pulled taut. The front face (or watch movement) 520 is dropped into a corresponding recess 545 in the casing 510 and attached via the locking system 540. The locking system 540 may comprise a threaded section 515 disposed on the outer perimeter of front face 520 that is configured to mate with a corresponding threaded section 535 disposed within recess 545. In some embodiments, the locking system 540 is similar to that of a medicine bottle, i.e., the cap (front face) makes an audible snap when fully screwed onto the bottle (casing) so that it does not come undone during use. A rubber gasket may be employed to provide a tight seal, thereby ensuring the timepiece remains waterproof. The watch battery may be accessed by removing the front face 520.

Figure 6A:
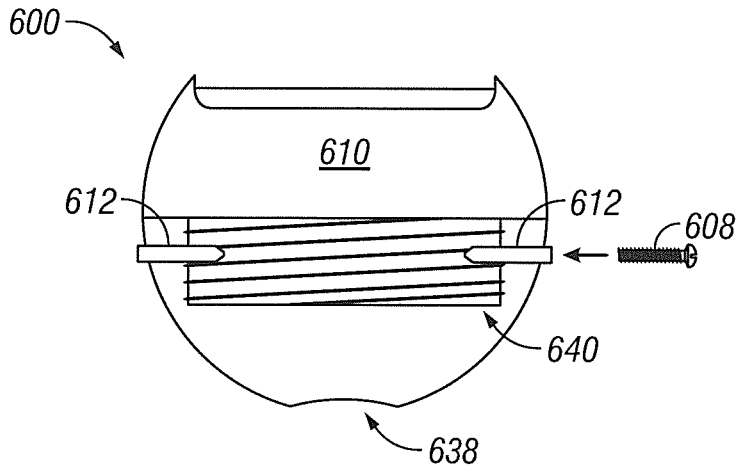
FIGS. 6A-6C are cross-sectional, top chamber and bottom chamber views, respectively, illustrating an attachable timepiece having an additional locking mechanism in accordance with the principles of the invention.
Figure 6B:
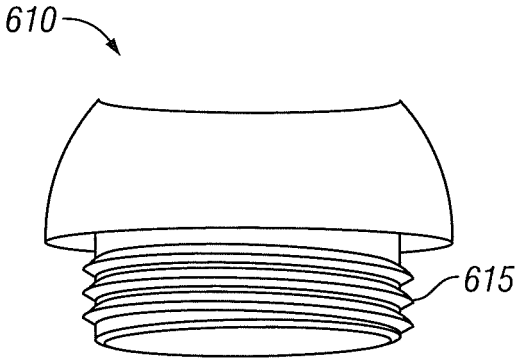
Figure 6C:
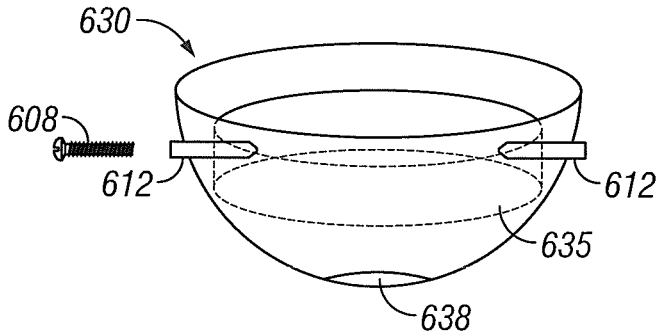

FIGS. 6A-6C illustrate an attachable timepiece 600 having an additional locking mechanism in accordance with the principles of the invention. The timepiece 600 is similar to the timepiece of FIGS. 1A and 1B with the exception of the additional locking mechanism, which may comprise one or more screws 608 configured to pass through corresponding apertures 612 in the upper and lower chambers 610, 630. In the illustrated embodiment, the locking system 640 comprises a threaded section 615 disposed on the outside of upper chamber 610 that is configured to mate with a corresponding threaded section 635 disposed on the inside of lower chamber 630. In addition, the locking system 640 further comprises screws 608, which are inserted into the apertures 612 to provide further assurance that the chambers 610, 630 will not detach during use. The lower chamber 630 includes a centrally disposed aperture 638 for the passage of the looped string.

Figure 7A:
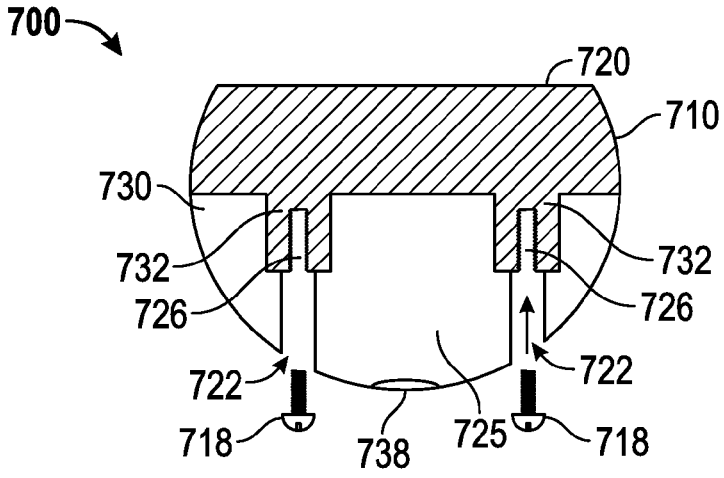
FIGS. 7A-7C are cross-sectional, top chamber and bottom chamber views, respectively, illustrating an attachable timepiece having an alternative locking mechanism in accordance with the principles of the invention.
Figure 7B:
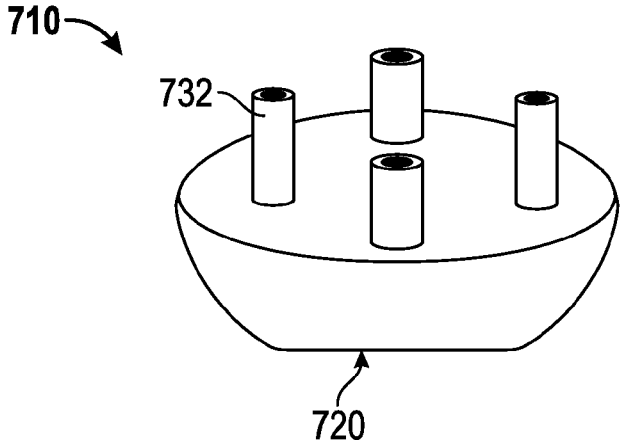
Figure 7C:
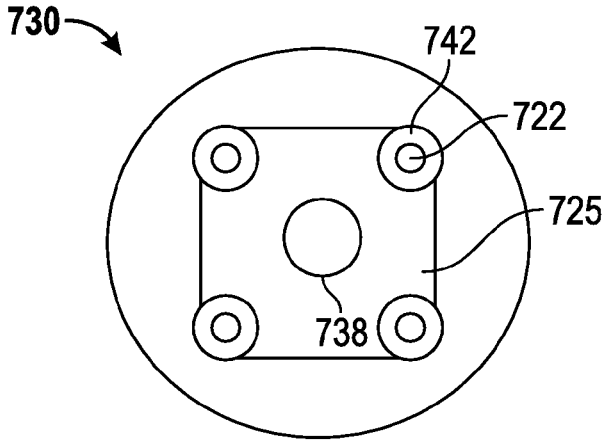

FIGS. 7A-7C illustrate an attachable timepiece 700 having an alternative locking mechanism in accordance with the principles of the invention. Unlike the timepiece of FIGS. 1A and 1B, the upper and lower chambers 710, 730 are connected using a plurality of screws 718 that pass through apertures 722 in the lower chamber 730 and into threaded engagement with apertures 726 in screw bases 732 of the upper chamber 710. These screw bases 732 are projections of the upper chamber 710 that fit within corresponding recesses 742 in the lower chamber 730. Similar to the timepiece of FIGS. 1A and 1B, the lower chamber 730 includes a front face 720, a hollow portion 725 for the knot of the looped string, and a centrally disposed aperture 738 for the passage of the looped string. Although the illustrated embodiment include four screws 718, it is hereby noted that any number of screws, or other means of attachment, may be employed without departing from the scope of the invention.

Figure 8A:
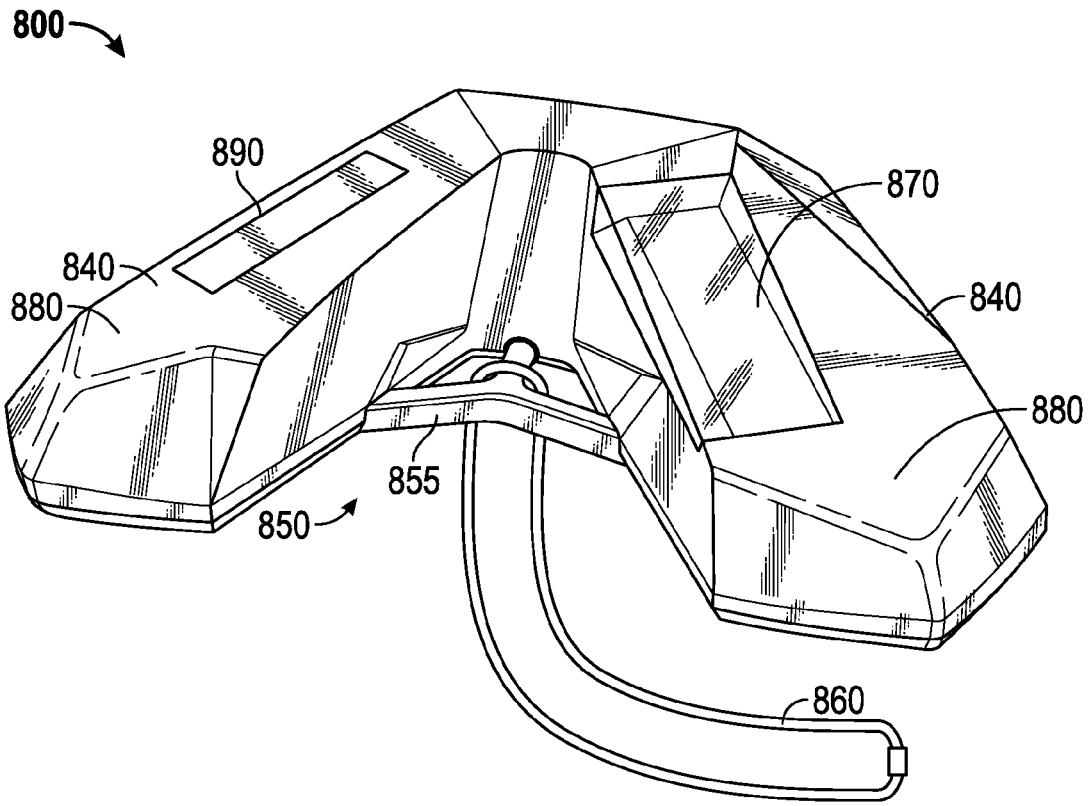
FIGS. 8A-8B are perspective views of attachable timepieces according to further embodiments of the invention.
Figure 8B:
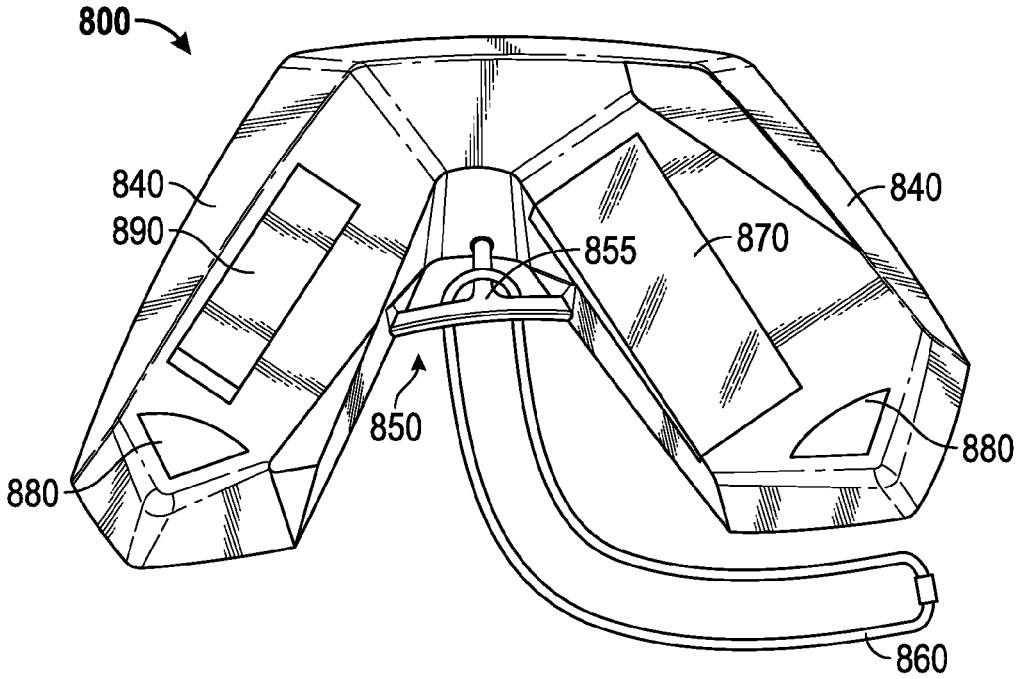

FIGS. 8A and 8B are perspective views of another attachable timepiece 800 according to a further embodiment of the invention. As depicted, the timepiece 800 includes a pair of arms 840 connected to each other at an angle. In the illustrated embodiment, the arms form an acute angle with respect to one another. More particularly, the timepiece 800 comprises a substantially boomerang shape or V-shape. The arms are hollow such that they can be used to house electronic components such as circuits boards, batteries, and other conventional electronic components. As would be appreciated by those of skill in the art, many other timepiece shapes may be employed without departing from the scope of the invention. The attachable timepiece 800 further comprises a means 850 for attaching the timepiece 800 to an object such as the plug of a surfboard. As depicted in FIG. 8A, this means for attachment may comprise a bar locking system 850 located in a wedge area of the timepiece 800 where the arms 840 are joined. In the illustrated embodiment, the bar locking system 850 comprises a pair of bars 855 formed in a substantially T-shaped configuration, and a looped string 860 threaded through the bars.

Similar to the embodiment of FIGS. 2A-2C, timepiece 800 can be attached to a surfboard 200 with a tail end 210 having a conventional leash plug 220 for attaching looped string 860 to the surfboard 200. Any suitable looped string 860 may be employed to releasably attach the timepiece 800 to the leash plug 220 of the surfboard 200. In particular, looped string 860 is looped through the plug 220 and pulled until it is taut, such that the looped string 860 can now take the place of a conventional surfboard leash string. In other words, the looped string 860 is threaded through the plug 220 such that when the string 860 is pulled, the timepiece 100 is forced against the plug 220. However, since the timepiece 800 is larger than the plug 220, it remains in place adjacent the plug 220.

With further reference to FIGS. 8A and 8B, the timepiece 800 further comprises an LCD time display 870, a user interface system 880, and a solar panel 890 for powering the timepiece using only the sun's energy. In some embodiments, the LCD time display 870 comprises a KENT time display featuring a reading for water temperature and the ability to set a vibrating alarm to alert the surfer when a selected amount of time has expired. The vibrating alarm helps to alert the surfer at times when the ambient sound would overwhelm a conventional audible alarm. In the illustrated embodiment, the user interface system 880 comprises a two-button user interface system comprising a pair of buttons disposed on the distal ends of the timepiece arms 840.

Figure 9:
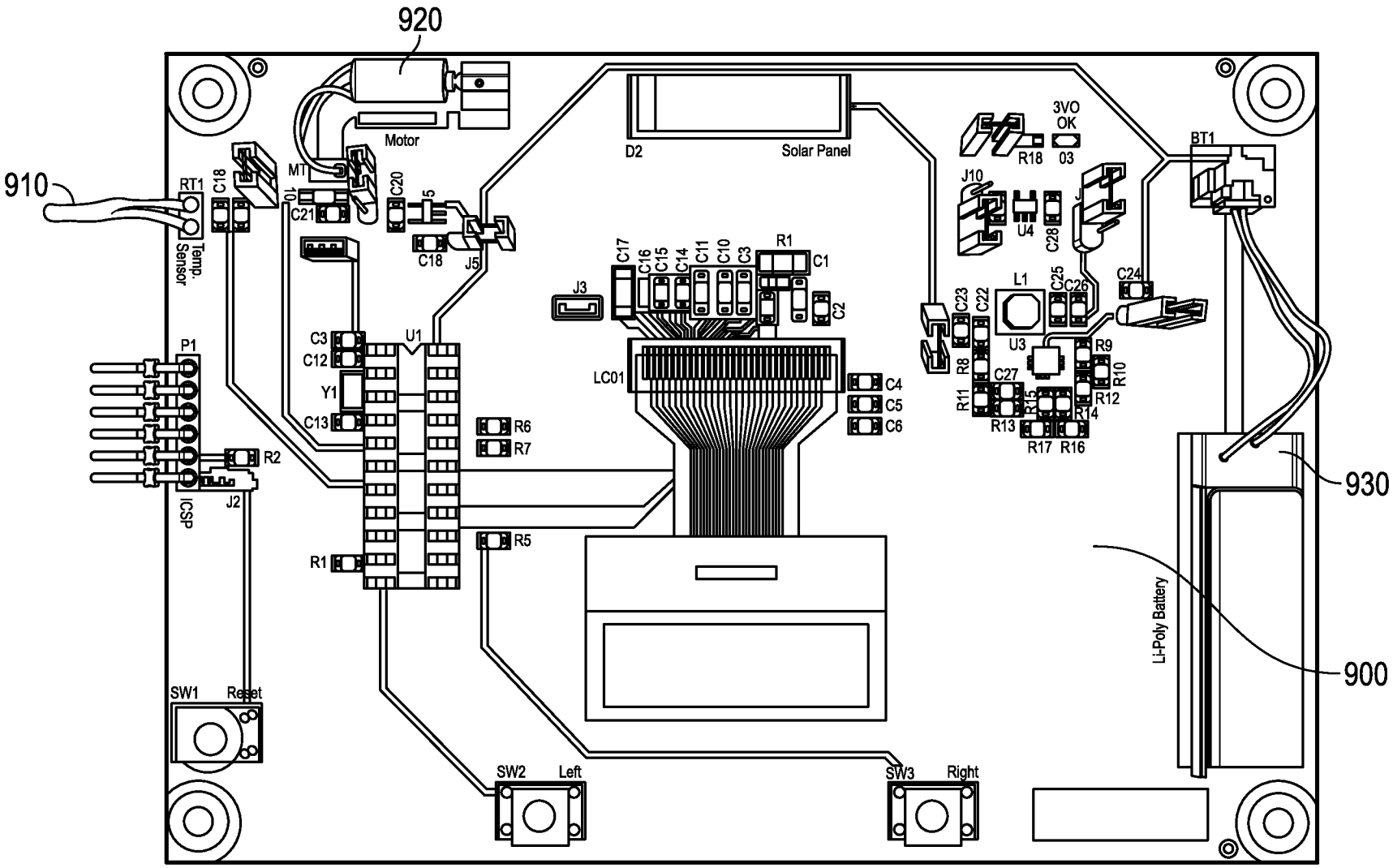
FIG. 9 is a top view of an exemplary circuit board to be housed within an attachable timepiece of the invention.

FIG. 9 is a top view of an exemplary circuit board 900 to be housed within an attachable timepiece of the invention such as within one of the arms 840 of the attachable timepiece 800 depicted in FIGS. 8A and 8B. The circuit board 900 includes various conventional working components. Also attached to the circuit board 900 is a thermistor 910 to be employed as a water temperature sensor, vibrating alarm 920, and solar charged lithium polymer battery 930. As would be appreciated by those of skill in the art, any type of conventional battery may be employed without departing from the scope of the invention.

Figure 10:
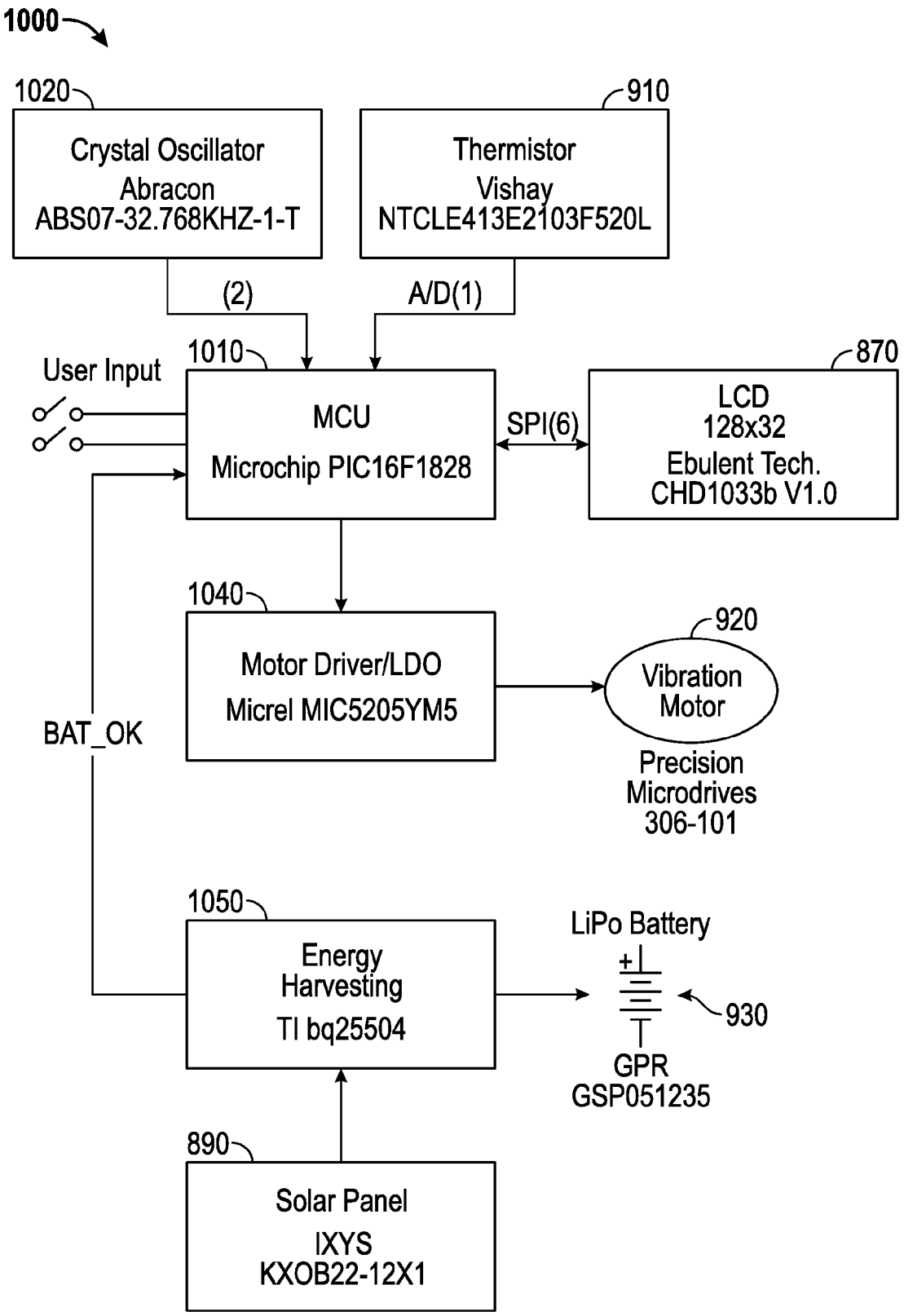
FIG. 10 is a block diagram of the exemplary circuit board of FIG. 9.

FIG. 10 is a block diagram 1000 of the exemplary circuit board of FIG. 9. Specifically, the block diagram 1000 depicts a number of components that are connected electrically and/or mechanically to microcontroller 1010. These components may comprise a crystal oscillator 1020, thermistor 910, LCD 870, motor driver 1040, vibration motor 920, and energy harvesting device 1050 for transferring energy from solar panel 890 to lithium polymer battery 930. In the illustrated embodiment, the microcontroller 1010 receives user input 1060 from the two-button user interface system 880 depicted in FIGS. 8A and 8B.

Figure 11A:
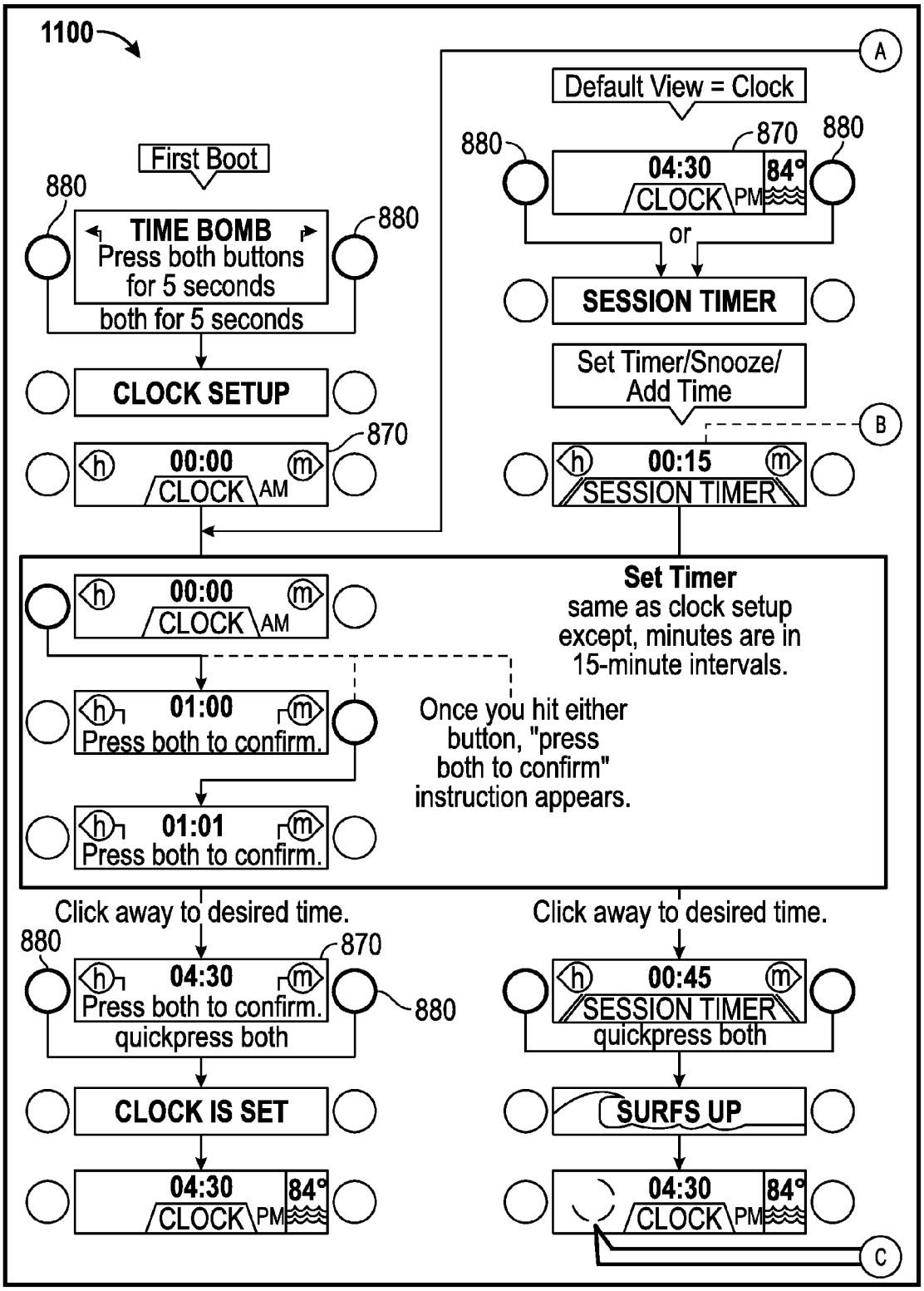
FIG. 11A illustrates exemplary user interface functionality for a Clock Setup, Time Bomb, and Session Timer.
Figure 11B:
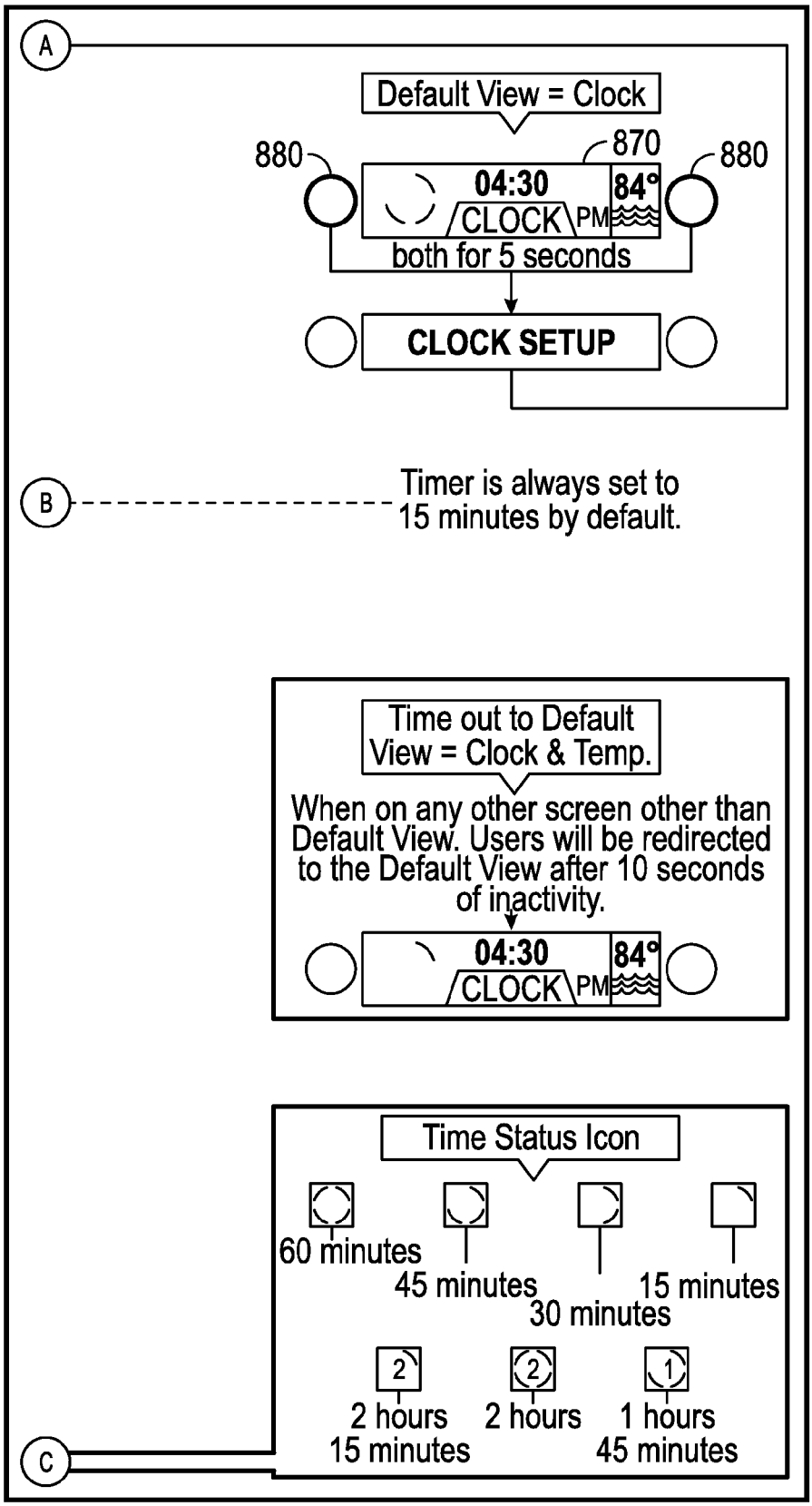
FIG. 11B illustrates exemplary user interface functionality for a Clock Setup, Default View, and Time Status Icon.
Figure 11C:
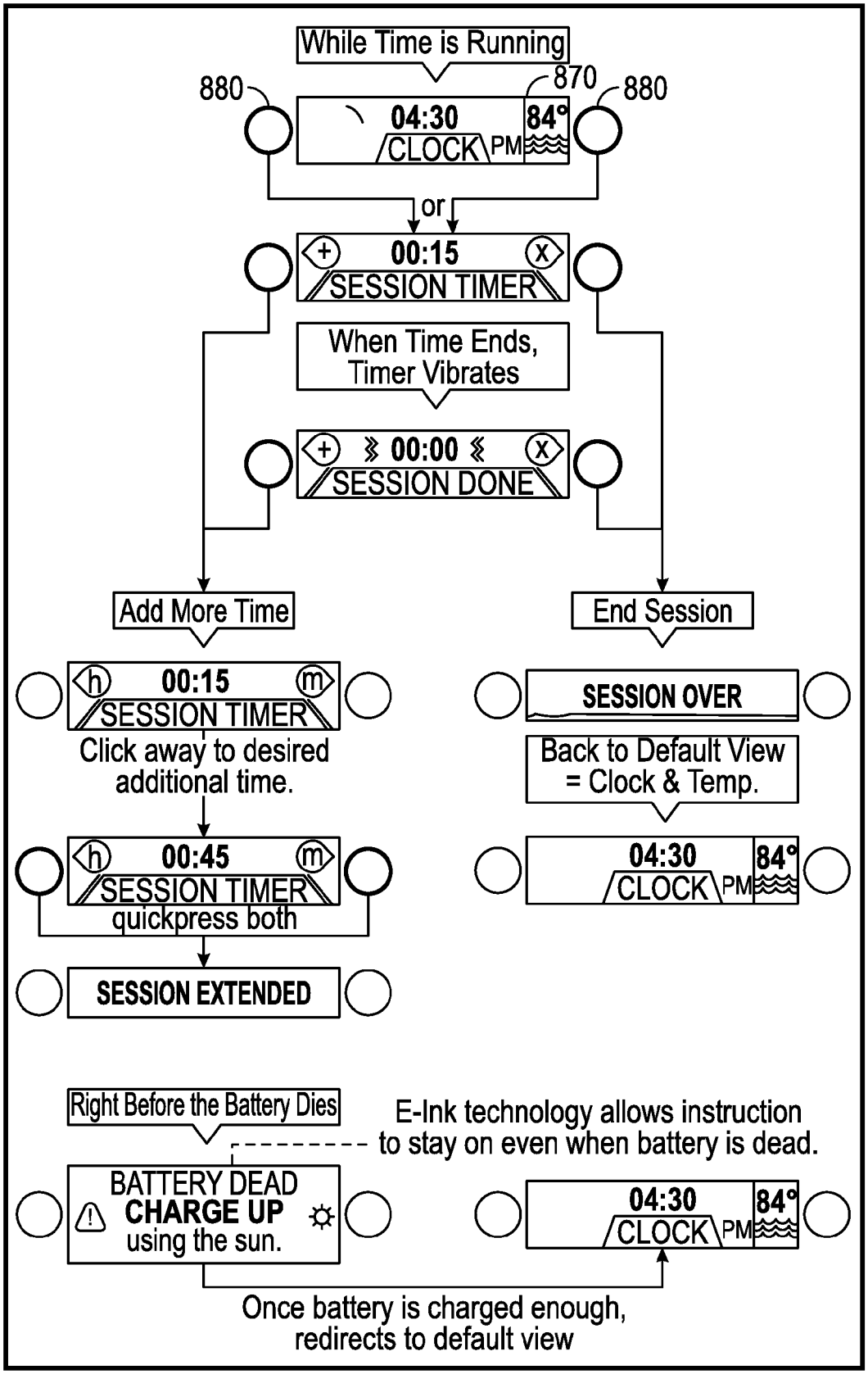
FIG. 11C illustrates exemplary user interface functionality for a Session Timer, and Charge Up.

FIGS. 11A-11C are diagrams illustrating an exemplary built-in user interface 1100 and corresponding functionality. In particular, FIG. 11A illustrates exemplary user interface functionality for Clock Setup, Time Bomb, and Session Timer. FIG. 11B illustrates exemplary user interface functionality for Clock Setup, Default View, and Time Status Icon. FIG. 11C illustrates exemplary user interface functionality for Session Timer and Charge Up. According to an embodiment of the invention, the built-in user interface 1100 including LCD time display 870 and two-button user interface system 880. One of skill in the art will appreciate that other types of time displays and user interfaces may be possible without departing from the scope of the invention. The diagrams of FIGS. 11A-11C show a user how to employ the two-button interface 880 to boot up the system and set the clock. The two-button interface also allows the user to set a session timer in 15-minute intervals, and extend the session timer as desired.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. These illustrations and their accompanying description should not be construed as mandating a particular architecture or configuration.

The invention claimed is:

1. A timepiece, comprising:

first and second arms connected at one end at an acute angle; and a bar locking system located in a wedge area of the timepiece where the arms are connected at the acute angle;

wherein the first and second arms are hollow such that they can house electrical components;

wherein the bar locking system is employed to attach the timepiece to a leash plug of a surfboard.

2. The timepiece of claim 1, wherein the timepiece comprises a boomerang shape.

3. The timepiece of claim 1, wherein the timepiece comprises a V-shape.

4. The timepiece of claim 1, wherein the bar locking system comprises a pair of bars formed in a substantially T-shaped configuration, and a looped string threaded through the bars.

5. The timepiece of claim 1, further comprising a display including the time and a reading for water temperature.

6. The timepiece of claim 1, further comprising a vibrating alarm to alert the surfer when a selected amount of time has expired.

7. The timepiece of claim 1, further comprising a user interface system comprising a two-button user interface system having a pair of buttons disposed on the distal ends of the timepiece arms.

8. The timepiece of claim 1, further comprising a thermistor for measuring water temperature.

9. The timepiece of claim 1, further comprising a solar panel for capturing the sun's energy and a solar charged lithium polymer battery for powering the timepiece using the captured energy.

10. A timepiece, comprising:

first and second arms connected at one end at an acute angle; and a means for attaching the timepiece to an object;

wherein the first and second arms are hollow such that they can house electrical components.

11. The timepiece of claim 10, wherein the timepiece comprises a boomerang shape.

12. The timepiece of claim 10, wherein the timepiece comprises a V-shape.

13. The timepiece of claim 10, wherein the means for attaching the timepiece comprises a bar locking system located in a wedge area of the timepiece where the arms are connected at the acute angle.

14. The timepiece of claim 13, wherein the bar locking system comprises a pair of bars formed in a substantially T-shaped configuration, and a looped string threaded through the bars.

15. The timepiece of claim 10, wherein the object comprises a leash plug of a surfboard.

16. The timepiece of claim 10, further comprising a display including the time and a reading for water temperature.

17. The timepiece of claim 10, further comprising a vibrating alarm to alert the surfer when a selected amount of time has expired.

18. The timepiece of claim 10, further comprising a user interface system comprising a two-button user interface system having a pair of buttons disposed on the distal ends of the timepiece arms.

19. The timepiece of claim 10, further comprising a thermistor for measuring water temperature.

20. The timepiece of claim 10, further comprising a solar panel for capturing the sun's energy and a solar charged lithium polymer battery for powering the timepiece using the captured energy.

* * * * *